US009308664B2

(12) United States Patent
Kalbacher et al.

(10) Patent No.: US 9,308,664 B2
(45) Date of Patent: Apr. 12, 2016

(54) SYSTEM AND METHOD FOR PRODUCING APERTURES IN TUBES

(71) Applicant: Modine Manufacturing Company, Racine, WI (US)

(72) Inventors: Klaus Kalbacher, Rangendingen (DE); Daniel Borst, Neckartenzlingen (DE)

(73) Assignee: Modine Manufacturing Company, Racine, WI (US)

( * ) Notice: Subject to any disclaimer, the term of this patent is extended or adjusted under 35 U.S.C. 154(b) by 148 days.

(21) Appl. No.: 13/934,614

(22) Filed: Jul. 3, 2013

(65) Prior Publication Data

US 2014/0013907 A1 Jan. 16, 2014

(30) Foreign Application Priority Data

Jul. 12, 2012 (DE) ..... 10 2012 014 073
Jul. 17, 2012 (DE) ..... 10 2012 014 096

(51) Int. Cl.
*B26F 1/00* (2006.01)
*B26F 1/24* (2006.01)

(52) U.S. Cl.
CPC ..... *B26F 1/0015* (2013.01); *B26F 1/24* (2013.01); *Y10T 83/0481* (2015.04); *Y10T 83/395* (2015.04); *Y10T 83/9314* (2015.04)

(58) Field of Classification Search
CPC ..... B21D 28/28; B21D 28/34; B21D 26/033; B26F 1/24; B26F 1/0015; Y10T 83/0481; Y10T 83/395; Y10T 83/9314; E21B 23/01; E21B 31/20; E21B 43/11
USPC ..... 83/30, 31, 39, 56, 875, 515, 518, 192, 83/188.618, 620, 40–50
See application file for complete search history.

(56) References Cited

U.S. PATENT DOCUMENTS 1,507,291 A * 9/1924 Jones ..... E21B 31/20 166/215
1,728,136 A * 9/1929 Power ..... E21B 31/20 294/86.15

(Continued)

FOREIGN PATENT DOCUMENTS

CN 101642790 2/2010
CN 102125954 7/2011

(Continued)

OTHER PUBLICATIONS

German Patent Office Action for Application No. 102012014096.7 dated Feb. 21, 2013 (10 pages).

(Continued)

*Primary Examiner* — Sean Michalski
*Assistant Examiner* — Liang Dong
(74) *Attorney, Agent, or Firm* — Michael Best & Friedrich LLP

(57) ABSTRACT

Methods for producing slots in tube walls are described and illustrated, along with devices for producing slots in tube walls. In some cases, a first number of punches arranged in a row pierce through the tube wall and in so doing produce slots, followed by another number of punches piercing through the tube wall in such a way that the slots produced by the first number of punches alternate with respect to the slots produced by the second number of punches. Also, in some cases an internal support is used, whereby small slots are first produced in the tube wall while the internal support is within the tube. After the internal support is removed, the slots are widened to finished dimensions. The internal support can include upper and lower parts designed to engage one another in a sawtooth or undulating manner.

8 Claims, 6 Drawing Sheets

(56) References Cited

U.S. PATENT DOCUMENTS

| | | | | | |
|---|---|---|---|---|---|
| 1,787,358 | A | * | 12/1930 | Clay | 30/363 |
| 2,325,437 | A | | 7/1943 | Temple | |
| 2,983,167 | A | | 5/1961 | Huet | |
| 3,259,003 | A | * | 7/1966 | Griffin | 83/54 |
| 3,848,497 | A | | 11/1974 | Lancaster et al. | |
| 4,679,289 | A | | 7/1987 | Miller | |
| 5,088,193 | A | | 2/1992 | Okada et al. | |
| 5,737,952 | A | * | 4/1998 | Baumann | B21D 26/045 72/325 |
| 6,386,588 | B1 | * | 5/2002 | Young et al. | 280/821 |
| 6,601,492 | B1 | | 8/2003 | Schusheim | |
| 7,146,738 | B2 | * | 12/2006 | Yu | 30/358 |
| 7,562,609 | B2 | | 7/2009 | Ueno | |
| 2006/0162170 | A1 | | 7/2006 | Yu | |

FOREIGN PATENT DOCUMENTS

| | | |
|---|---|---|
| DE | 2231517 | 1/1974 |
| DE | 19508177 | 9/1996 |
| DE | 4334203 | 8/2003 |
| DE | 102006028490 | 5/2007 |
| DE | 10103176 | 6/2010 |
| DE | 102011013209 | 9/2012 |
| EP | 1674170 | 6/2006 |
| GB | 561602 | 5/1944 |
| GB | 807608 | 1/1959 |
| JP | 2002028736 | 1/2002 |
| WO | 2006095754 | 9/2006 |
| WO | 2012119697 | 9/2012 |

OTHER PUBLICATIONS

German Patent Office Action for Application No. 102012014073.8 dated Feb. 14, 2013 (4 pages).

International Search Report for Application No. PCT/EP2012/000681 dated Jun. 4, 2012 (3 pages).

First Office Action from the State Intellectual Property Office of the People's Republic of China for Application No. 201310292481.3 dated Nov. 3, 2015 (16 pages).

* cited by examiner

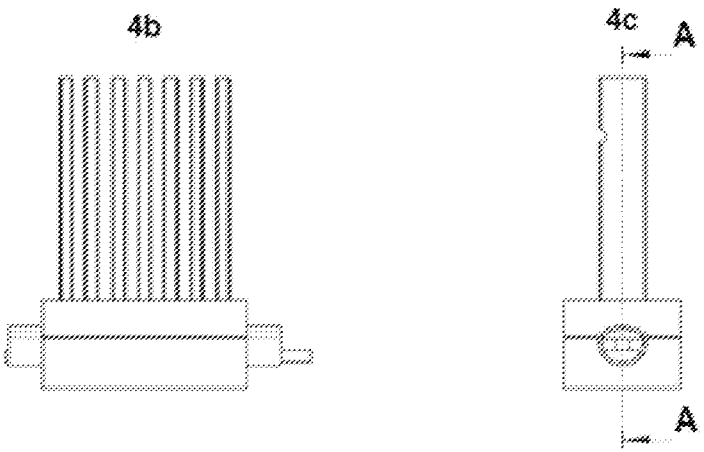
FIG. 4
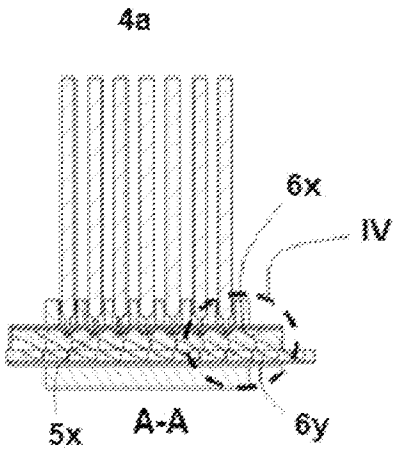

SYSTEM AND METHOD FOR PRODUCING APERTURES IN TUBES

RELATED APPLICATIONS

Priority is hereby claimed to German Patent Application No. 102012014073.8 filed on Jul. 12, 2012 and to German Patent Application No. 102012014096.7 filed on Jul. 17, 2012. The entire contents of both of these German patent applications are incorporated herein by reference.

FIELD OF THE INVENTION

The present invention relates to devices and methods for producing slots in a tube wall, wherein a multiplicity of punches arranged in a row pierces through the tube wall and in so doing produces the slots. Some embodiments of the present invention also relate to such devices and methods in which means of an internal support of the tube are used.

BACKGROUND

A production method having a multiplicity of punches arranged in a row is known from DE 4 334 203 C2. In that patent, there are embodiments with two dies to be introduced into the tube, which dies together fill out the tube cross section. Other embodiments in the cited document use only a single die which likewise fills out the entire tube cross section. In the case of the production of the slots by means of a single die, it is provided that, after the formation of the slots, the die is rotated through 180° out of the working position into a refracted position in order that the die can be removed from the tube again. Realizing large rotational travels, however, can have an adverse effect on the cost-effectiveness of the manufacturing process, because longer cycle times could be necessary. Also, to be able to realize adequately large collars on slot edges, the die disclosed in DE 4,334,203 C2 has, between its axially arranged supporting portions, axial connecting portions of relatively weak form (connecting portions—see FIG. 7, reference no. 4 in DE 4 334 203 C2). Cracks may therefore form in the die. Furthermore, DE 4 334 203 C2 discloses only circular tubes. However, it is desirable to be able to provide tubes of as wide a variety of cross-sectional shapes as possible with the slots.

U.S. Pat. No. 5,088,193 A also relates to the slotting of circular tubes and the use of an inner die. Here, by contrast to DE 4 334 203 C2 cited above, there is not a multiplicity of punches arranged in a row. By contrast, in U.S. Pat. No. 5,088,193 A, it is provided that, firstly, in first working steps, embossings are formed in the tube wall by means of an arcuate punch corresponding to the tube contour. In the tube there is situated the die, the cross section of which is only slightly smaller than the inner tube cross section. The die is subsequently removed from the tube, and in second working steps, the slots are formed in the embossings by means of a piercing tool. A rotational movement of the die is not necessary, because said die is in the form of a continuous circular bar without supporting and connecting portions. There is nevertheless a disadvantage at least with regard to the cost-effectiveness of the manufacturing process. Also with regard to U.S. Pat. No. 5,088,193 A, a pressing tool is used for the first steps and a slotting or piercing tool is used for the further steps, which can be regarded as being disadvantageous.

In the production of slots as described above, basically no cuttings are produced as waste, whereby said methods are distinguished from other known methods in which holes are firstly cut out and the hole edges are subsequently bent into the form of flanges.

In other known applications, tubes to be slotted are filled with a liquid in order to support the tubes from the inside during the production of the tube slots.

SUMMARY

An object of the invention is that of providing an improved production method for producing slots in a tube wall, and a corresponding device for executing the method.

Some embodiments of the present invention provide a production method comprising a first step, that is, a first pass, wherein a first number of punches is pierced through the tube wall in order to generate slots, and in a second step, a second number of punches is pierced through the tube wall. The slot from the first step is followed by a slot from the second step positioned in a row.

In such embodiments, the punches from the first step can remain in their slots until the second step has been executed, and all of the punches can be subsequently pulled out of the slots. For the execution of the steps, the tube can be placed into a tube bed and supported from the outside. It has been found that, with such an approach, an internal support (die) for the tube wall is superfluous. The production of slots is possible with adequate quality and accuracy.

It has been found that a deformation of the slots is counteracted as a result of the punches remaining in the slots. Whether or not it is necessary for the punches to remain in the slots is dependent on how strict the accuracy requirements are in the individual situation. It has however also been found that the shape rigidity of the tube wall is increased by the slots generated in the first step. Said increased shape rigidity has the effect, if certain spacing of the slots is maintained, of counteracting an inadmissible deformation during the execution of the second step. The design of the punch tips and other influential factors can also play a role here.

The slotting tool is designed such that a first number of punches can be activated for a first step and such that the punches arranged between the punches of the first step can be activated for a second step.

In some embodiments of the present invention, a production method provides that, in at least one first step, small slots are produced, and in a second step, a support is removed from the tube, and in at least one third step, the slots from the first step are widened to a preferred final dimension (finished dimension). As a refining measure in such embodiments, it is proposed that the first and third steps are executed by means of the same punches, which can be pierced into the tube wall in a single pass in each case. The penetration depth of the punches into the tube wall is greater during the course of the third step than in the first step. This yields at least reduced outlay in terms of tooling. It is advantageous that, for the execution of the steps, the tube is placed into a tube bed in order to support it from the outside. It is also provided that, within the second step, the cross section of the internal support is reduced in size before the internal support is retracted out of the tube, for example, by virtue of said internal support being moved from a working position into a retraction position.

The device according to some embodiments of the invention is characterized in that the internal support (if used) is constructed from an upper part and from a lower part which are designed such that they can engage into one another in an approximately saw-tooth or undulating manner.

Other aspects of the invention will become apparent by consideration of the detailed description and accompanying drawings.

BRIEF DESCRIPTION OF THE DRAWINGS

FIGS. 4-6 show, with respect to another embodiment, respectively in a longitudinal section (a), in a frontal view (b) corresponding to the longitudinal section (a) and in a side view (c), a moment of the first method step (FIG. 4), a moment of the second method step (FIG. 5), and finally a moment of the third method step (FIG. 6).

In FIGS. 4-6, a dashed oval line indicates the detail view (FIGS. 7-9, respectively) in each case.

Figure 5:
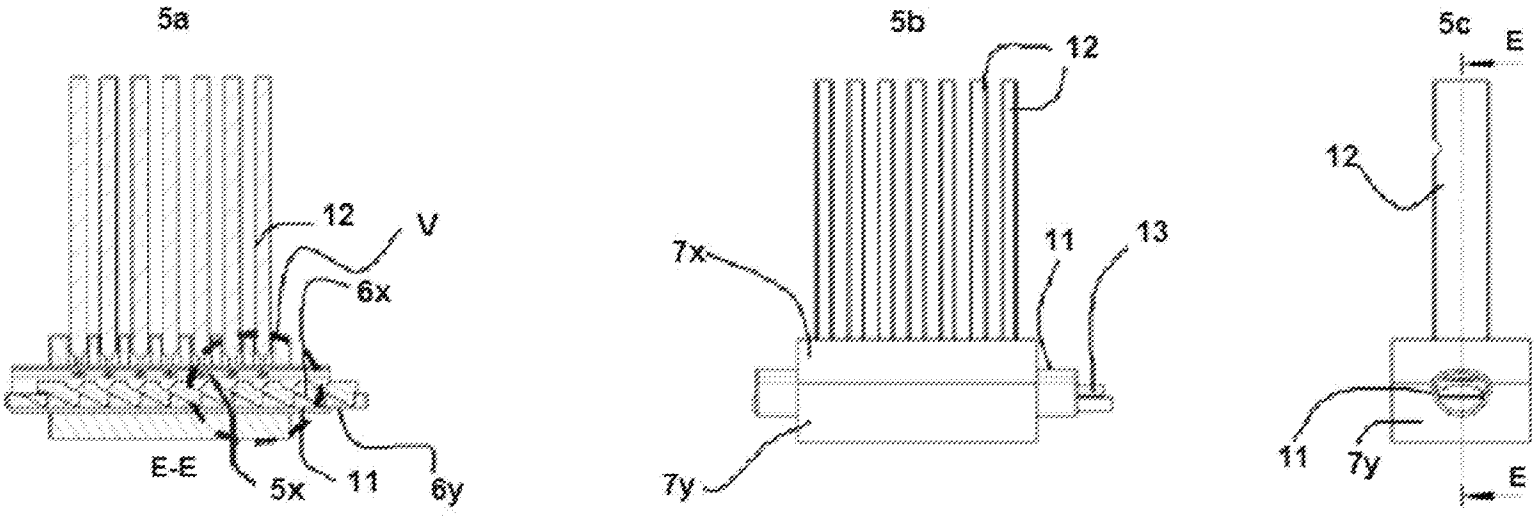

Reference signs used in the following description have been plotted primarily in the illustrations of FIGS. 2, 5 and 7. They apply in the same way to the illustrations in the other figures.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Tubes 10 to be processed according to the various embodiments of the present invention may be produced for example from an aluminum alloy. Tube production may take place by extrusion, by tube forming from sheet-metal plates and welding along a longitudinal seam, or by means of other production methods. The tubes 10 may be, for example, collecting tubes of a heat exchanger. The slots 1, 5 (see FIGS. 1-3 of the first illustrated embodiment described below, and FIGS. 4-7 of the second illustrated embodiment also described below) are then receiving openings for the ends of heat exchanger tubes which are for example brazed therein. The cross section of the tube 10, 11 (see FIG. 1*z* and FIG. 4*c* of the illustrated embodiments) is, in the exemplary embodiments shown, approximately D-shaped, wherein the slots 1*a*, 1*b* or 5*x*, 5*y* are formed into the flattened or less intensely curved cross-sectional region of the tube 10, 11 and can extend in the transverse direction approximately over the entire flattened region. However, it should be noted that this description need not necessarily relate to tubes 10, 11, and may also relate to a wall (e.g., curved wall) which is to be provided with slots 1, 5 or with slot-like passages.

Figure 1:
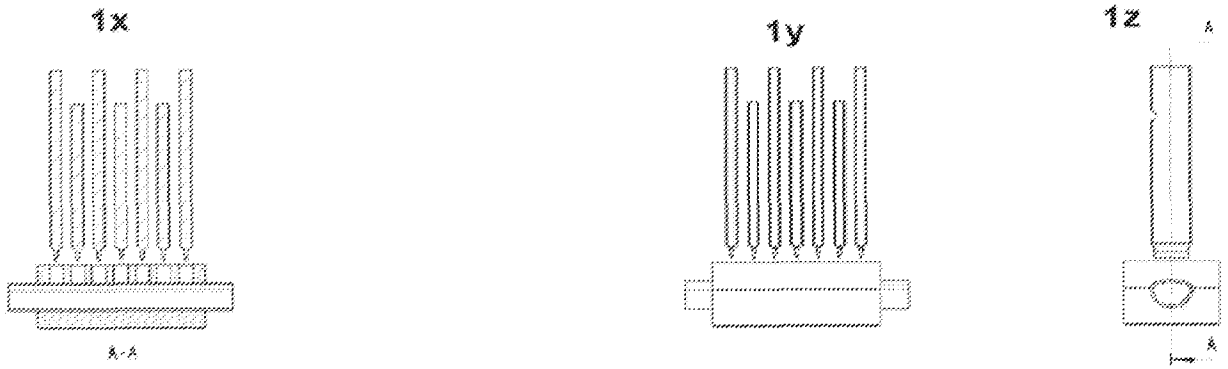
FIGS. 1-3 show, respectively in a longitudinal section (x), in a frontal view (y) corresponding to the longitudinal section (x) and in a side view (z), the initial stage (FIG. 1), an intermediate stage (FIG. 2) after the execution of the first step, and a final stage (FIG. 3) before retraction of the punches.
Figure 2:
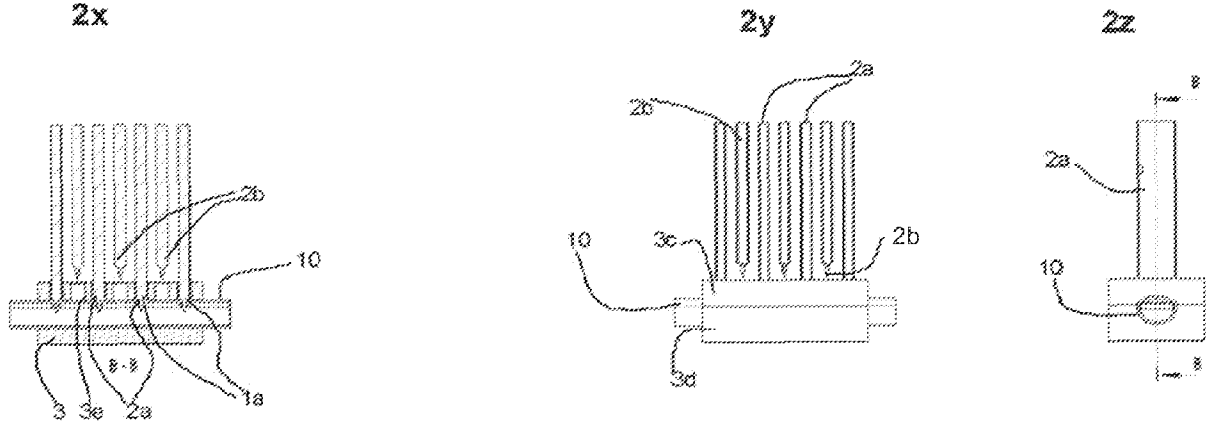
Figure 3:
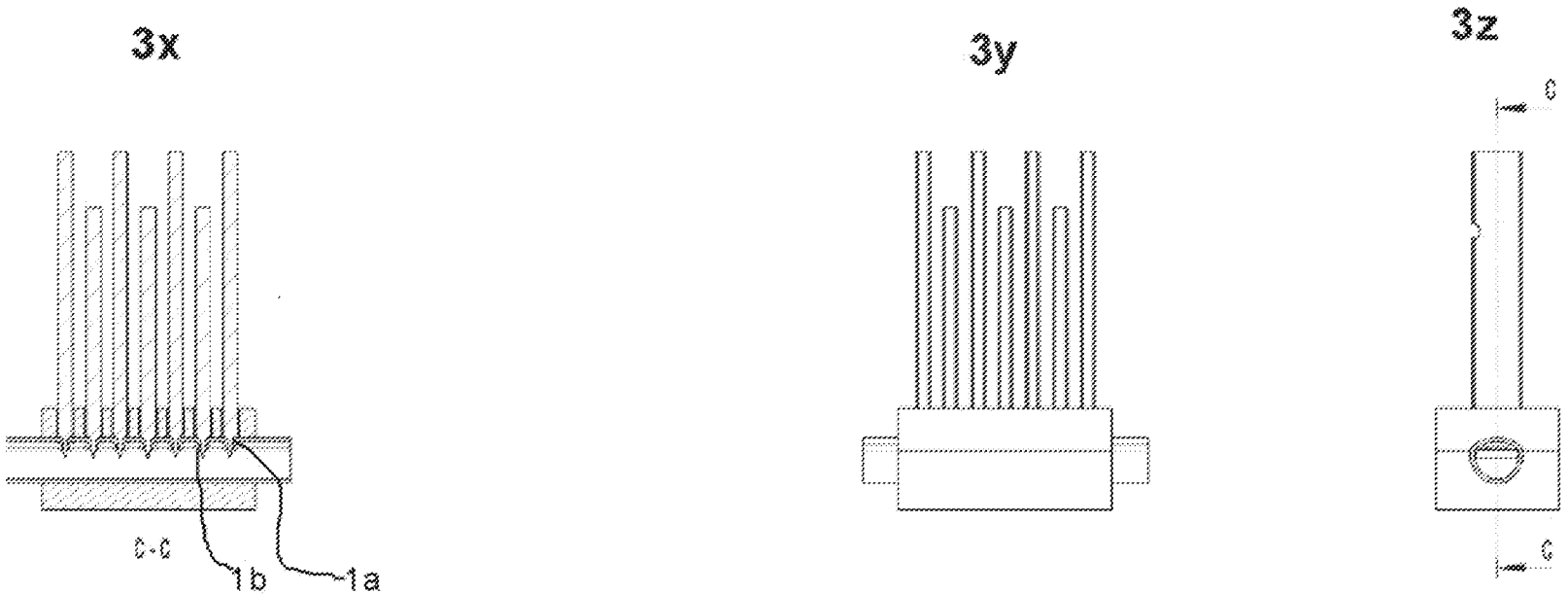

As can be seen from the embodiment of FIGS. 1-3 in which seven punches 2*a*, 2*b* and seven corresponding slots 1*a*, 1*b* are shown by way of example only, the first number of punches 2*a*/slots 1*a* is precisely four, and the second number of punches 2*b*, which are used in the second step, is three. Both the first step and the second step are executed in each case in one pass.

It can be inferred from the illustrated embodiment of FIGS. 1-3 and from the above description that a minimum number of three punches 2*b* is required in order to execute the method, wherein in the first step, two outer punches 2*a* are used, and in the second step, an interposed third punch 2*b* is used. Accordingly, to produce more than three slots 1*a*, 1*b*, the tube 10 (or the slotting tool) can be displaced cyclically in the longitudinal direction as often as required to produce the desired overall number of slots 1*a*, 1*b* (not illustrated).

There is little sense in specifying an upper limit for the first and second numbers. This will depend on numerous obvious circumstances. Without the invention being restricted hereto, a sensible number of punches/slots in the case of a collecting tube 10 for (for example) an air-conditioning condenser could be approximately twenty, wherein, in the first step and in the second step, in each case ten punches 2*a*, 2*b* could be used.

As shown most clearly in FIG. 2, four illustrated punches 2*a* are pierced through the tube wall 10 simultaneously (that is to say as already mentioned, in one pass) in the first step in order to generate four slots 1*a*.

As is also then shown in FIG. 3, in the second step, the remaining three punches 2*b* are pierced through the tube wall 10 simultaneously such that, in the row, a slot 1*a* from the first step is followed by a slot 1*b* from the second step. In other words, in a single first step, every second punch 2*a* in the punch row is activated, and in a single second step, the punches 2*b* arranged respectively therebetween are activated.

In the exemplary embodiment of FIGS. 1-3 as shown, the punches 2*a* from the first step remain in their slots 1*a* until the second step has been executed. Thereafter, all of the punches 2*a*, 2*b* are pulled out of the slots 1*a*, 1*b*.

Also with reference to the exemplary embodiment of FIGS. 1-3, for the execution of the steps, the tube 10 is placed into a tube bed 3 and supported from the outside. The illustrated tube bed 3 is in two parts. In particular, the tube bed 3 has an upper part 3*c*, with corresponding passages 3*e* for punch guidance, and a lower part 3*d*, such that in the exemplary embodiment of FIGS. 1-3, external support is provided around the full tube circumference.

Figure 6:
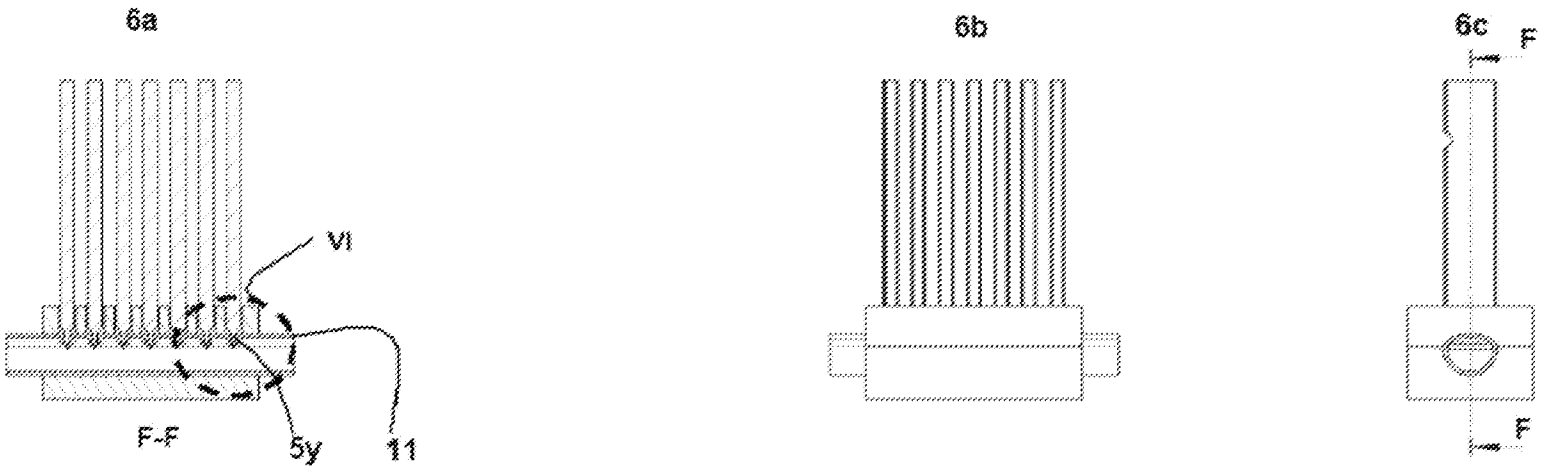
Figure 7:
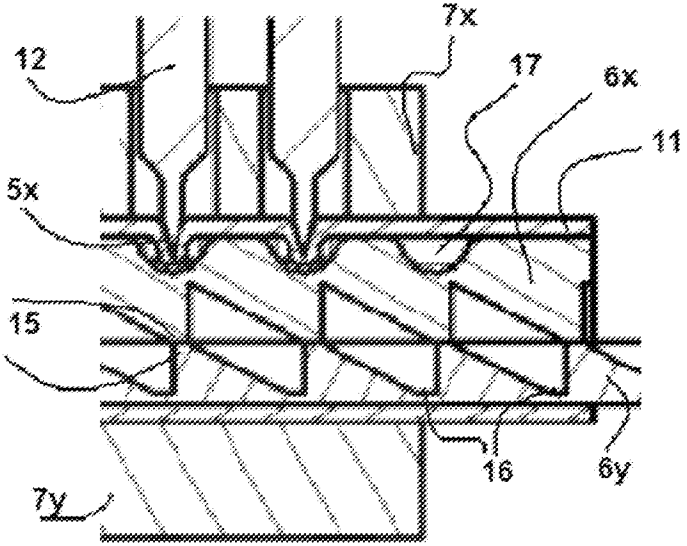

Another embodiment of the present invention is illustrated in FIGS. 4-9. FIGS. 4 and 7 show production of small slots 5*x* performed within a first step. The small slots 5*x* can be initially no more than small incisions in the inner tube surface, said incisions however already having the inwardly extending beginnings of a bent-up collar 5*y* (see FIG. 9). Within the context of this embodiment, the small slots 5*x* should be understood as such even if they are possibly not yet proper passage openings.

As can be seen, for the execution of the first step in the embodiment of FIGS. 4-9, an internal support 13 is situated within the tube 11. The internal support 13 is composed of a part 6*x* and of another part 6*y*. In the exemplary embodiment shown, the two parts, which appear in the drawings as an upper part 6*x* and as a lower part 6*y*, have saw-tooth contours which engage into one another in order to be able to assume two positions, a working position and a retraction position. One version of the undulating shape is a saw-tooth shape.

In FIGS. 4 and 7, the support 13 is in the working position. In the working position, the upper saw-tooth tips 15 are supported against the lower saw-tooth tips 15, such that the support 13 can act as such, because it supports the tube wall from the inside in order to be able, by means of the punch 12, to produce the small slots 5*x* without this causing an inadmissible wall deformation. In some embodiments, it is preferable for all of the punches 12 of the punch row to be pierced into the wall in one pass in the first step. Corresponding notches 17 situated in the upper part 6*x* provide the necessary space for the penetrating punch tips 14 and for the formation of the collars 5*y*.

With continued reference to the embodiment of FIGS. 4-9, the method may in fact also be executed by means of a single punch 12. The punch 12 or the tube 11, for example, could then be displaced cyclically in order to generate a row of spaced-apart slots in the tube wall. In this case, the first and also the third step would then comprise in each case a number of punch movements corresponding to the number of desired slots.

Subsequently to the first step, the inner support 13 is moved axially into a retraction position which can be seen in FIGS. 5 and 8. In the refraction position, the upper saw-tooth tips 15 are situated in the lower saw-tooth troughs 16, such that a smaller cross section of the support 13 is provided which enables the support 13, even without being rotated about its longitudinal axis, to be pulled out of the tube 10 such as is provided in the second step.

In PCT/EP2012/000681, the Applicant proposed a single-part internal support (device), referred to in said document as a slotting tool, which can be moved from the working position into the retraction position by virtue of the support being rotated about its longitudinal axis. Said device is characterized in that, as viewed in the transverse direction (radial direction) it has two narrow sides which are arranged on opposite ends of a largest cross-sectional extent, wherein the device forms two axially extending supporting strips between the narrow sides and the inner side of the tube wall. Said support may be used instead of the device proposed here.

Figure 8:
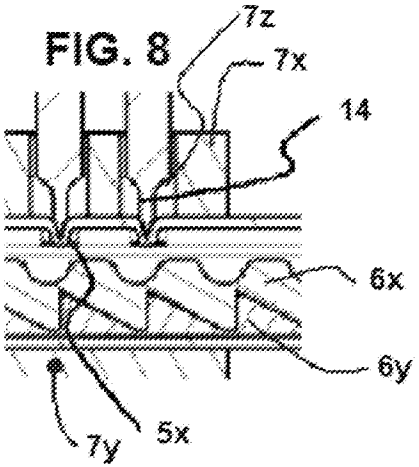
FIGS. 7-9 show enlarged details (IV from FIG. 4, V from FIG. 5 and VI from FIG. 6).
Figure 9:
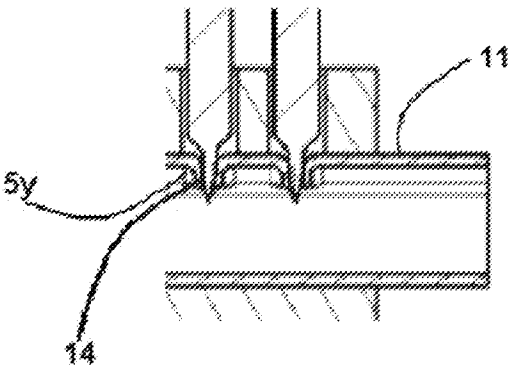

In a third step of the illustrated embodiment of FIGS. 4-9, the small slots 5*x* are, by way of their collars 5*y* from the first step, widened by means of the same punches 12, to the final dimension (finished dimension), as can be seen from FIGS. 6 and 9. The penetration depth of the punches 12 into the tube wall 11 is greater during the course of the third step than in the first step. It is also the case in the third step that all of the punches 12 can be pierced through the wall in one pass.

In theory, the steps could be divided into multiple partial steps, wherein the penetration depth is increased with each partial step. The production of the slots 5*x* can however practically be completed in a single third step.

The greater penetration depth and resulting widening of the small slots 5*x* to the preferably finished dimension of the slots 5*x* can be better seen from a comparison of FIG. 7 or 8 with FIG. 9. The illustrated punches 12 have a conical punch tip 14. It is also possible to more clearly see that the slots 5*x* are provided with the above-mentioned, inwardly directed collars 5*y* which are larger, or higher, in the case of the fully formed slots 5*x* than in the case of the small slots 5*x*. The adjustment of the support 13 from the working position into the retraction position is necessary also owing to said collars 5*y*. The support 13 should, as should be apparent, have adequate freedom of movement in order to be able to be pulled out of the tube.

For the execution of the production steps in the illustrated embodiment of FIGS. 4-9, the tube 11 is placed into a two-part tube bed 7*x*, 7*y*. The tube bed 7*x*, 7*y* has a part 7*x* and another part 7*y* which, in the drawings, are likewise present as an upper part 7*x* and as a lower part 7*y* in order to support the tube 11 from the outside on all sides. Passages 7*z* for guiding the punches 12 are situated in the upper part 7*x*.

What is claimed is:

1. A method for producing slots in a tube wall of a tube using a plurality of punches arranged in a row, the method comprising:

piercing through the tube wall with the plurality of punches to create a plurality of slots in the tube wall while an internal support is located within the tube;

removing the internal support from within the tube; and widening each of the plurality of slots to a finished dimension, subsequent to removing the internal support from within the tube.

2. The method according to claim 1, wherein the piercing and widening steps are executed with the same plurality of punches; and penetration of the punches into the tube wall is greater in the widening step than in the piercing step.

3. The method according to claim 1, further comprising placing the tube into a tube bed in order to support the tube from the outside during the piercing and widening steps.

4. The method according to claim 1, further comprising moving the internal support from a working position to a retraction position to reduce a cross-sectional size of the support before removing the support from within the tube.

5. The method according to claim 1, further including moving an upper part of the internal support relative to a lower part of internal support which includes moving a plurality of upper part tips of the upper part to engage a plurality of lower part tips of the lower part to configure the internal support into a working position and moving the plurality of upper part tips to engage a plurality of lower part troughs of the lower part to configure the internal support into a retraction position.

6. The method according to claim 5, further including configuring the internal support into the retraction position before removing the internal support from within the tube, and wherein removing the internal support from within the tube further includes removing the internal support together as a whole unit.

7. The method according to claim 6, wherein removing the internal support as a whole unit includes moving the upper part and the lower part in the same direction.

8. The method according to claim 3, wherein placing the tube into a tube bed further includes placing the tube between an upper tube bed part and a lower tube bed part, and further including guiding the plurality of punches by passages in either of the upper tube bed part or the lower tube bed part.

* * * * *